United States Patent [19]

Nakajima et al.

[11] 3,938,330

[45] Feb. 17, 1976

[54] EXHAUST MANIFOLD WITH SLUICE VALVE

[75] Inventors: Yasuo Nakajima, Yokosuka; Yoshimasa Hayashi, Yokohama; Tadahiro Yamamoto, Yokosuka, all of Japan

[73] Assignee: Nissan Motor Company Limited, Yokohama, Japan

[22] Filed: July 17, 1974

[21] Appl. No.: 489,110

[30] Foreign Application Priority Data

July 18, 1973 Japan ..... 48-81854

[52] U.S. Cl. ..... 60/294; 60/282; 60/292; 60/323; 60/324

[51] Int. Cl.[2] ..... F02B 75/10

[58] Field of Search ..... 60/324, 323, 282, 280, 60/602, 603, 292, 294; 415/205, 148, 151

[56] References Cited

UNITED STATES PATENTS

| | | | |
|---|---|---|---|
| 2,674,086 | 4/1954 | Nichols | 60/280 |
| 3,423,926 | 1/1969 | Nancarrow | 415/205 |
| 3,798,906 | 3/1974 | Woolenweber | 60/280 |

FOREIGN PATENTS OR APPLICATIONS

| | | | |
|---|---|---|---|
| 1,319,974 | 1/1963 | France | 415/205 |

*Primary Examiner*—Douglas Hart

[57] ABSTRACT

A valve disposed in the central space of the manifold normally divides the space into two halves to avoid mutual interference of exhaust gas flows. At low engine speeds, the valve causes the exhaust gas flows from all branches to be disturbed and to mix with each other, to promote oxidation of HC and CO.

3 Claims, 1 Drawing Figure

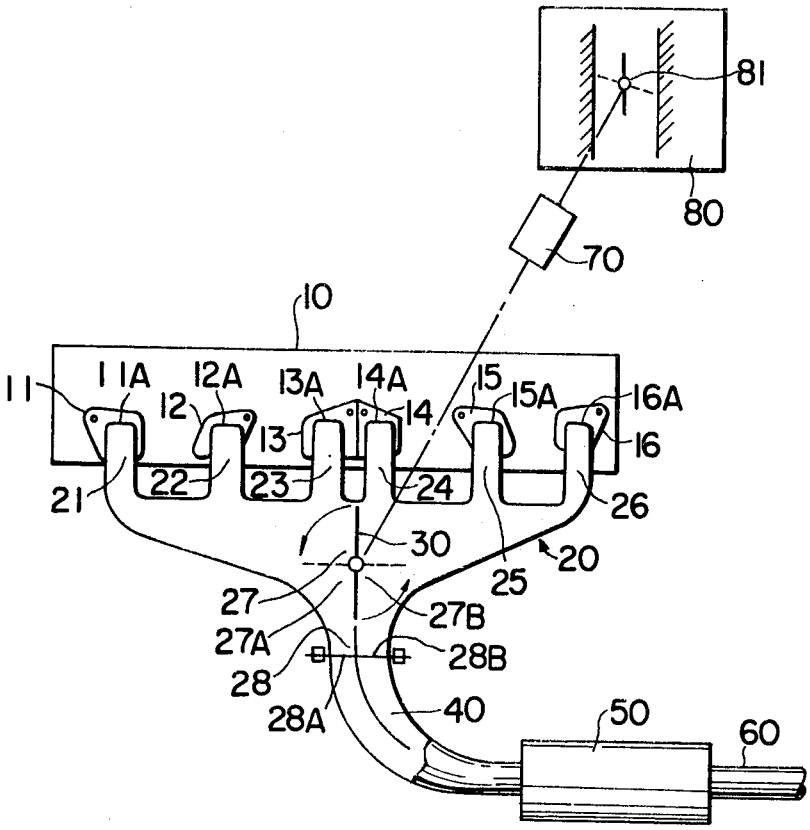
81
80
70
10
11
11A
12A
13A
14A
15
15A
16A
12
13
14
16
21
22
23
24
26
30
20
25
27
27B
27A
28B
28
28A
40
50
60

EXHAUST MANIFOLD WITH SLUICE VALVE

The present invention relates generally to an exhaust manifold for internal-combustion engines, and more particularly to an exhaust manifold for an engine having six or more cylinders, with a sluice valve to control the exhaust gas flow according to the engine speed.

Exhaust manifolds for straight-type or in-line multi-cylinder internal-combustion engines are usually designed to avoid the exhaust gas flow from each cylinder interfering with one another. For example, a conventional exhaust manifold for an in-line six-cylinder engine, which is fired in the order of 1-5-3-6-2-4, comprises two groups of branches, i.e., one group for cylinders No. 1 to No. 3 and the other for No. 4 to No. 6. The two groups are connected separately to a dual-passageway front tube of an exhaust pipe assembly.

Meanwhile, conventional internal-combustion engines are confronted with a problem of making the exhaust gas cleaner, or free from unburned hydrocarbons (HC) and carbon monoxide (CO). As is known, these substances are discharged in abundance at low engine speeds while a remarkable reduction is observed at higher or normal engine speeds. To solve the problem, an exhaust system often requires a device such as a thermal reactor, in which HC and CO are converted into harmless oxides.

Bearing such state of the art in mind, it is an object of the present invention to provide an exhaust manifold having means to control the interflow of the exhaust gas so that oxidation of HC and CO can be assisted while an exhaust gas flow from each cylinder can be prevented from unfavorably interfering with each other.

According to the improvement of the invention to an exhaust manifold for a straight-type multi-cylinder engine having six or more engine cylinders, having a plurality of branches arranged generally in line and divided into two adjoining groups of equal number and an exhaust outlet divided into two passageways communicating with the two groups of branches, respectively:

a valve is disposed in an interior space of the manifold between the branches and the outlet thereof, in an arrangement to substantially divide the space into two halves so that an exhaust gas flow from a branch of one group is prevented from being mixed with the subsequent exhaust gas flow from another branch of the other group within the space, and the valve is automatically movable to a position to cause exhaust gas flows from all the branches to be disturbed and to mix with each other within the space when the engine speed falls below a predetermined value.

Other features and advantages of the invention will become apparent from the following detailed description of a preferred embodiment thereof taken with the accompanying drawing, in which:

The single FIGURE is a diagram of an exhaust manifold for a 6-cylinder engine according to the invention with associated elements.

In the FIGURE, an exhaust manifold 20 is assembled with an in-line six-cylinder engine 10 to conduct exhaust gases from exhaust ports 11A-16A of engine cylinders 11–16 through branches 21–26 of the manifold 20, respectively, into a central space or junction region 27, where the exhaust gas flows join each other. The firing sequence of the cylinders or combustion chambers 11 to 16 is 11-15-13-16-12-14. A sluice valve such as a rotatable plate or a butterfly valve 30 is disposed in the space 27, and an exhaust outlet 28, which is divided into two sections or passageways 28A and 28B, is joined with a dual-passageway type front tube 40 of an exhaust pipe assembly. The front tube 40 is connected with a thermal reactor, an after-burner or a catalytic converter 50, which discharges a cleaned exhaust gas into an exhaust pipe 60.

When the engine 10 is in normal operation, or is running at relatively high speeds, the valve 30 remains in a position as shown by the solid line in the FIGURE so that the space 27 is substantially divided into two halves 27A and 27B. Accordingly, the left side branches 21–23 are substantially prevented from communicating with the right side branches 24–26, and the exhaust gas flow from, for example, the cylinder 11 will not substantially interfere with the subsequent exhaust gas flow from the cylinder 15. The exhaust manifold 20 of the invention under these conditions works similarly to a conventional manifold. When the engine speed decreases below a certain value, the valve 30 is rotated to the position as shown by the broken line in the FIGURE to allow the upstream portion of the space 27 to freely communicate with all the branches 21–26 and to increase the resistance to every exhaust gas flow. Consequently, exhaust gases from all the cylinders 11 to 16 are forced to dwell for some time in the upstream region of the junction space 27, and are mixed with each other at considerably high temperatures. The prolonged retention and mixing of the exhaust not only allow HC and CO to be partially oxidized in the manifold 20 but also promotes the subsequent reactions in the reactor or converter 50. Although the interference of the exhaust gas flow under such condition results in engine power reduction to a certain extent, it is of little consequence at low engine speeds.

The position or direction of the valve 30 is controlled by a control unit 70, which may be a combination of a sensor to detect the engine speed, an electromagnetic valve and switches. Preferably, the control unit 70 may further include a sensor to detect the magnitude of vacuum in a throttle section 81 of a carburetor 80 for the engine 10. It suffices for the purpose of the invention to select the position of the valve 30 from the two positions as described before and shown in the FIGURE. It is unnecessary to allow the valve 30 to take an intermediate position, so that relatively simple conventional valve control means may be employed as a fundamental portion of the control unit 70. By way of example, the valve 30 is rotated through 90° to establish a maximum restriction to the exhaust gas flows when the engine speed drops below 3000 rpm and the intake vacuum becomes lower than −100 mmHg.

As seen from the above description, the object of reducing the concentration of HC and CO in the exhaust gas at low engine speeds can be achieved by the provision and control of the sluice valve 30 according to the invention. The valve 30 has no adverse effect on normal exhaust gas flow from a plurality of cylinders at higher or normal engine speeds.

The exhaust manifold 20 of the FIGURE can be used with the same result also when the firing order of the engine cylinders 11–16 is 11-14-12-16-13-15. An exhaust manifold according to the invention can be used similarly for an in-line 8-cylinder engine when the firing sequence is such that the exhaust gas discharges occur on alternate sides of the valve 30.

In conventional 4-cylinder engines, the firing order of 4 cylinders is either 1-2-4-3 or 1-3-4-2, so that an exhaust manifold of the invention has little meaning for these engines. It is possible to utilize the invention on the condition that the firing order is modified to 1-4-2-3 or 1-3-2-4, but such a modification inevitably raises the problem of engine balance. Therefore, the present invention is practically inapplicable to a four-cylinder engine.

What is claimed is:

1. In an exhaust system of a motor vehicle which has an internal combustion engine of the straight-type six or more cylinders, the engine having a carburetor with an induction passageway, the system having an exhaust manifold and means arranged downstream of the exhaust manifold for converting unburned hydrocarbons and carbon monoxide contained in the exhaust gas of the engine into harmless substances before emission into the atmosphere, said exhaust manifold having at least six inlet branches each communicating respectively with each of the engine cylinders, the inlet branches being arranged generally in lateral alignment and divided into two adjoining groups of equal number, and an exhaust outlet communicating with said means, said outlet being divided into two passageways communicating with the two groups of inlet branches, respectively, the firing sequence of the engine being such that each cylinder communicating with the inlet branch of one group is fired alternately to each cylinder communicating with the inlet branch of the other group, the improvement comprising: the exhaust manifold defining a central space between all the inlet branches and the two passageways in such an arrangement that all the inlet branches communicate with the outlet through said space; the exhaust manifold further having a sluice valve rotatably disposed within said space such that said sluice valve normally occupies a position to partition said space into two half sections each communicating with one of the two groups of inlet branches and one of the two passageways, the exhaust system further having moving means selectively operable to move said sluice valve to another position wherein said two groups of inlet branches communicate with each other and with both of the two passageways, and control means detecting the engine speed and operating the moving means when the engine speed falls below a predetermined value.

2. The improvement as claimed in claim 1, wherein said control means comprise a pressure sensing means sensing the magnitude of vacuum in the induction passageway of the engine whereby said control means operates the moving means when the vacuum decreases below a predetermined magnitude.

3. The improvement as claimed in claim 1, wherein said sluice valve is a butterfly valve rotatable through at least 90° between said first and another positions respectively.

* * * * *